US006146093A

United States Patent [19]

Lammas et al.

[11] Patent Number: 6,146,093

[45] Date of Patent: Nov. 14, 2000

[54] VARIABLE VANE SEAL AND WASHER

[75] Inventors: Andrew J. Lammas, Maineville; Wayne R. Bowen, West Chester, both of Ohio

[73] Assignee: General Electric Company, Cincinnati, Ohio

[21] Appl. No.: 09/213,402

[22] Filed: Dec. 16, 1998

[51] Int. Cl.[7] ..... F01D 17/12

[52] U.S. Cl. ..... 415/160; 415/174.2; 415/162; 415/231

[58] Field of Search ..... 415/160, 164, 415/174.2, 159, 161, 162, 148, 230, 231, 170.1

[56] References Cited

U.S. PATENT DOCUMENTS

| | | | |
|---|---|---|---|
| 3,303,992 | 2/1967 | Johnson | 415/149.4 |
| 5,039,277 | 8/1991 | Naudet | 415/150 |
| 5,281,087 | 1/1994 | Hines | 415/160 |
| 5,308,226 | 5/1994 | Venkatasubbu et al. | 415/160 |
| 5,593,275 | 1/1997 | Venkatasubbu et al. | 415/160 |
| 5,622,473 | 4/1997 | Payling | 415/160 |
| 5,807,072 | 9/1998 | Payling | 415/170.1 |

*Primary Examiner*—Edward K. Look
*Assistant Examiner*—Rhonda Barton
*Attorney, Agent, or Firm*—Andrew C. Hess; Nathan D. Herkamp

[57] ABSTRACT

A seal and a washer for a variable vane assembly in a turbine engine are described. The seal includes a first portion and a second portion that are substantially perpendicular. The seal is positioned between a variable vane and a casing. The washer is substantially flat and is located between the casing and a spacer.

18 Claims, 3 Drawing Sheets

VARIABLE VANE SEAL AND WASHER

BACKGROUND OF THE INVENTION

This invention relates generally to turbine engines and, more particularly, to variable vane assemblies within a turbine engine.

Gas turbine engines generally include a high pressure compressor for compressing air flowing through the engine, a combustor in which fuel is mixed with the compressed air and ignited to form a high energy gas stream, and a high pressure turbine. The high pressure compressor, combustor, and high pressure turbine sometimes are collectively referred to as the core engine. Such gas turbine engines also may include a low pressure compressor for supplying compressed air, for further compression, to the high pressure compressor, and a fan for supplying air to the low pressure compressor.

The high pressure compressor typically includes a rotor surrounded by a casing. The casing is typically fabricated to be removable, such as by forming the casing into two halves that are then removably joined together. The high pressure compressor includes a plurality of stages and each stage includes a row of rotor blades and a row of stator vanes. The casing supports the stator vanes, and the rotor supports the rotor blades. The stator vane rows are between the rotor blade rows and direct air flow into a downstream rotor blade row.

Variable stator vane assemblies are utilized to control the amount of air flowing through the compressor to optimize performance of the compressor. Each variable stator vane assembly includes a variable stator vane which extends between adjacent rotor blades and the variable stator vane is rotatable about an axis. The orientation of the variable stator vane affects air flow through the compressor.

In a known variable vane assembly, a trunnion bushing is positioned around a portion of a variable vane so that the variable vane extends through the trunnion bushing. The assembly is bolted onto the high pressure compressor stator casing with the trunnion bushing between the variable vane and the casing. Such assemblies have possible gas leakage paths, such as between an outside diameter of the airfoil and an inside diameter of the bushing. In addition, another leakage path is between an outside diameter of the bushing and an inside diameter of the compressor stator case opening. Such leakage may result in failure of the bushing due to oxidation and erosion caused by the high velocity high temperature air. Once the bushing fails, an increase in leakage past the stator vane occurs, which results in a performance loss. In addition, the loss of the bushing allows contact between the vane and the casing which causes wear and increases the engine overhaul costs.

Accordingly, it would be desirable to provide a variable vane assembly that reduces, or eliminates, leakage of air through the casing. In addition, it would be desirable to provide such an assembly which is relatively inexpensive and simple to install.

BRIEF SUMMARY OF THE INVENTION

These and other objects may be attained by a compressor for a turbine engine that includes a plurality of rows of variable vane assemblies and each assembly includes a substantially flat washer between a casing and a spacer and a seal between a variable stator vane and the casing. The compressor further includes a plurality of rows of rotor blades between the rows of variable vane assemblies. The casing includes a first recessed portion, an inner wall, and a second recessed portion. The casing further includes an opening extending therethrough and formed by the inner wall. The variable vane assembly extends through the opening.

The seal includes a first portion and a second portion. The first portion is substantially perpendicular to the second portion. The seal first portion contacts the casing first recessed portion and extends along the first recessed portion. In addition, the seal second portion extends along the casing inner wall. The seal prevents the stator vane from contacting the stator casing and prevents air flow from exiting through the opening.

The washer contacts the casing second recessed portion and extends along the second portion. The washer has substantially the same width along its radial length. The washer preventing contact between the spacer and the casing.

The washer and the seal significantly restrict airflow, thus leading to a longer life of the variable vane assembly. In addition, an efficiency improvement is realized due to the reduced air leakage through the casing. Further, the engine overhaul costs will also be reduced since metal to metal contact between the stator casing, the stator vane, and the spacer is substantially reduced, or eliminated.

DETAILED DESCRIPTION OF THE INVENTION

Figure 1:
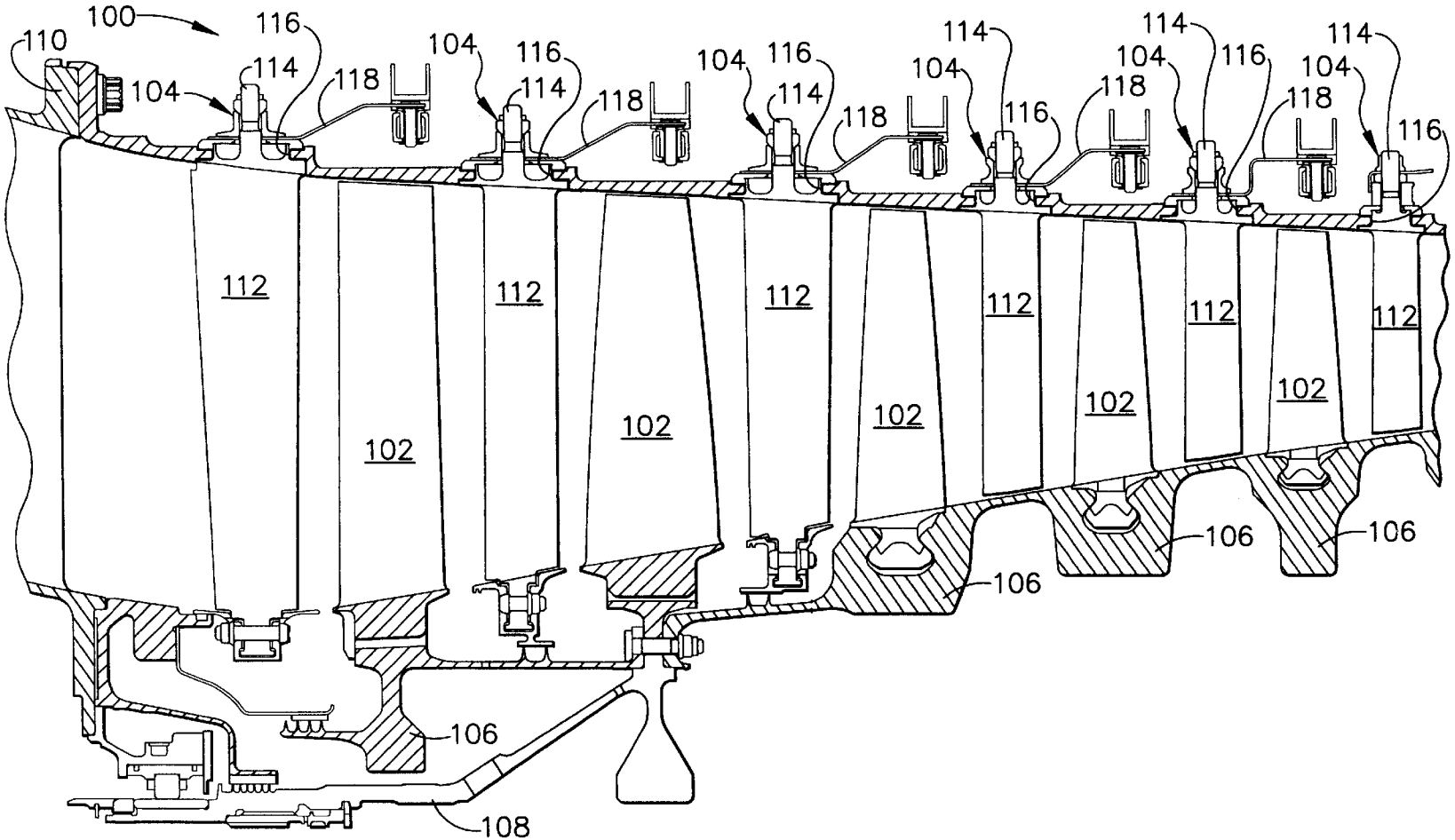
FIG. 1 (PRIOR ART)
FIG. 1 is a schematic view of a portion of a high pressure compressor for a turbine engine.

FIG. 1 is a schematic view of a section of a high pressure compressor 100 for a turbine engine (not shown). Compressor 100 includes a plurality of stages, and each stage includes a row of rotor blades 102 and a row of variable vane assemblies 104. Rotor blades 102 are typically supported by rotor disks 106, and are connected to a rotor shaft 108. Rotor shaft 108 is a high pressure shaft that is also connected to a high pressure turbine (not shown). Rotor shaft 108 is surrounded by a casing 110 that supports variable vane assemblies 104.

Variable vane assemblies 104 include a variable vane 112 and a vane stem 114 that protrudes through an opening 116 in casing 110. Variable vane assemblies 104 further include a lever arm 118 extending from variable vane 112. Lever arm 118 is utilized to rotate variable vanes 112. The orientation of vanes 112 relative to the flow path through compressor 100 controls air flow there through.

Variable vane assemblies 104 provide for increased control of air flow through compressor 100. However, variable vane assemblies 104 also provide a potential pathway for air flow to exit compressor 100, such as through opening 116. The loss of air flow through opening 116 reduces the efficiency of compressor 100.

Figure 2:
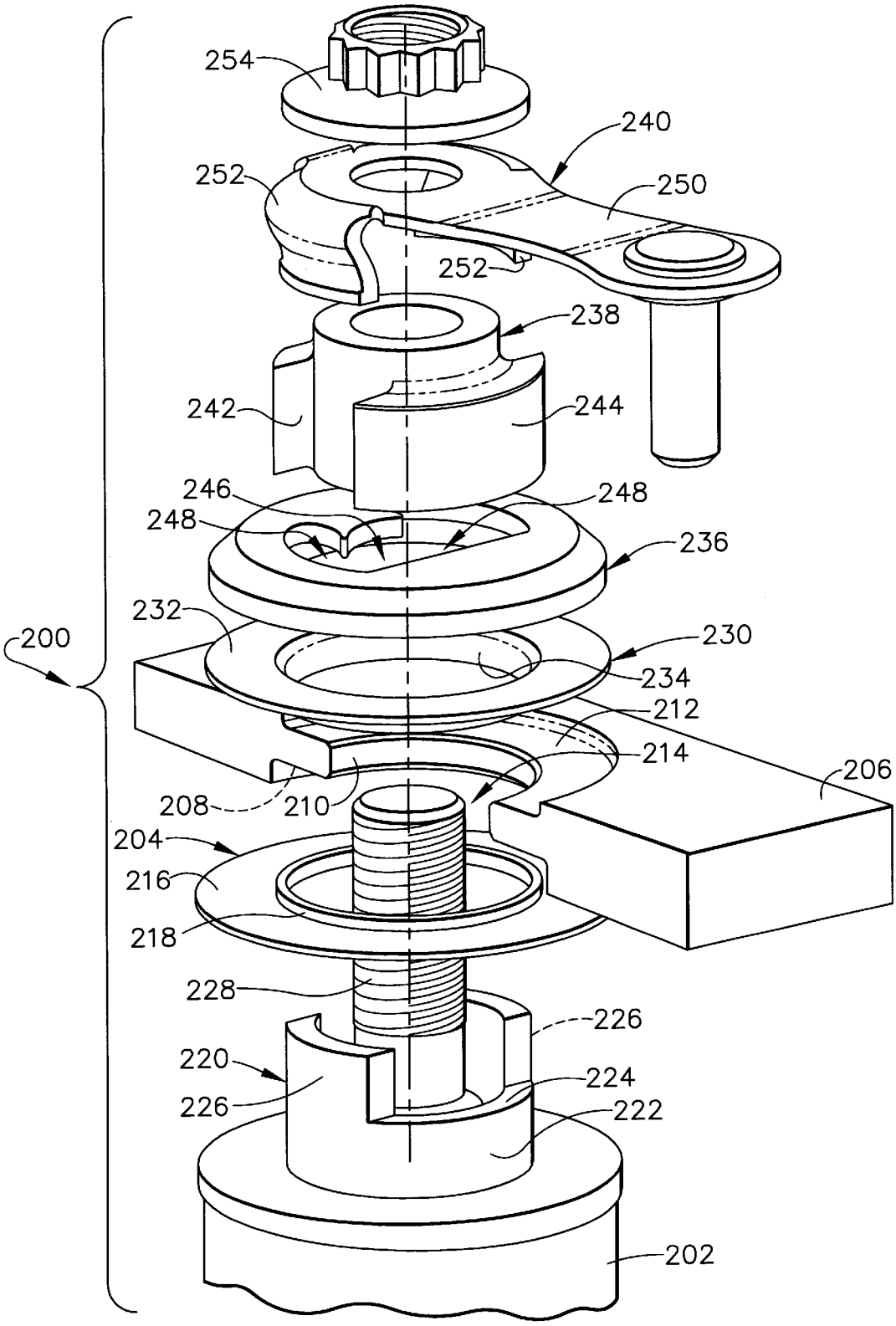
FIG. 2 (PRIOR ART)
FIG. 2 is an exploded view of a known variable vane assembly for a high pressure compressor of a turbine engine.

FIG. 2 is an exploded view of a known variable vane assembly 200 for use in a high pressure compressor (not shown in FIG. 2) of a turbine engine (not shown). Variable vane assembly 200 includes a variable vane 202 and a washer 204 positioned on variable vane 202. A casing 206 supports variable vane 202 and includes a first recessed portion 208, an inner wall 210, and a second recessed portion 212. An opening 214 extends through casing 206 and is border by inner wall 210. Washer 204 includes a first portion 216 and a second portion 218. Washer first portion 216 seats within first recessed portion 208 and separates variable vane 202 from casing 206. Washer second portion 218 is substantially perpendicular to first portion 216 and extends into opening 214. Washer second portion 218 contacts inner wall 210.

Variable vane 202 also includes a ledge 220 having an outer wall 222, a spacer seating surface 224, and two extensions 226. Ledge 220 surrounds a vane stem 228 and both vane stem 228 and ledge 220 extend through opening 214 in casing 206.

Variable vane assembly 200 further includes a bushing 230 having a first portion 232 and a second portion 234. First portion 232 is positioned on casing 206 and extends along second recessed portion 212. A spacer 236 contacts bushing first portion 232 and is separated from casing 206 by bushing first portion 232. Bushing second portion 234 extends along inner wall 210 of casing 206. Bushing second portion 234 prevents ledge outer wall 222 from contacting casing inner wall 210.

Variable vane assembly 200 also includes a sleeve 238 and a lever arm 240. Sleeve 238 is positioned around vane stem 228 and contacts spacer 236. Sleeve 238 includes a first extension portion 242 and a second extension portion 244. Extension portions 242, 244 contact spacer 236 and prevent sleeve 238 from sliding through an opening 246 in spacer 236. Spacer opening 246 includes two portions 248 that permit ledge extensions 226 to protrude therethrough and extend between sleeve extension first portion 242 and sleeve extension second portion 244. Lever arm 240 includes a first portion 250 and two second portions 252. Second portions 252 of lever arm 240 are configured to fit between first extension portion 242 and second extension portion 244 of sleeve 238. First portion 250 of lever arm 240 is utilized to adjust the angle of stator vane 202, and thus alter the flow of air through the compressor.

In addition, variable vane assembly 200 includes a lever arm nut 254 that contacts lever arm 240. Lever arm nut 254 cooperates with vane stem 228 and maintains variable vane assembly 200 in contact with casing 206.

Air may escape through opening 214 if air is able to pass by washer 204 and bushing 230. After air begins to flow by washer 204 and bushing 230, washer 204 and bushing 230 will rapidly deteriorate due to the high temperature and high pressure of the air.

Figure 3:
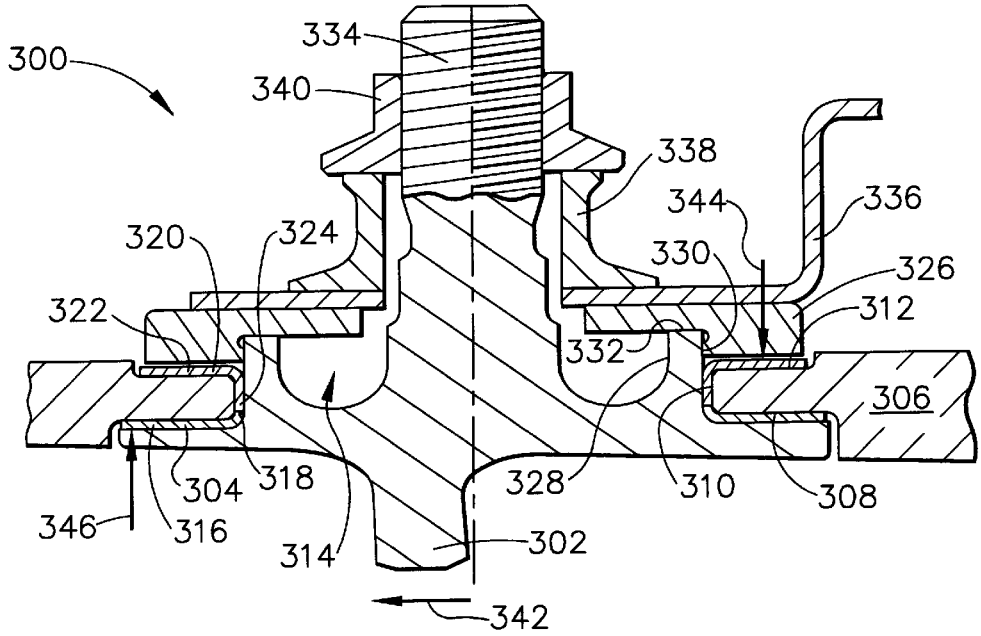
FIG. 3 (PRIOR ART)
FIG. 3 is a cross-sectional view of another known variable vane assembly.

FIG. 3 is a schematic view of another known variable vane assembly 300 illustrating forces acting on variable vane assembly 300. Variable vane assembly 300, for example, is a variable stator vane assembly for a high pressure compressor. Variable vane assembly 300 includes a variable vane 302 and a washer 304 positioned on variable vane 302. A casing 306 supports variable vane 302 and includes a first recessed portion 308, an inner wall 310, and a second recessed portion 312. An opening 314 is formed by inner wall 310. Washer 304 includes a first portion 316 and a second portion 318. Washer first portion 316 seats within first recessed portion 308 and separates variable vane 302 from casing 306. Washer second portion 318 is substantially perpendicular to first portion 316 and extends into opening 314. Washer second portion 318 contacts inner wall 310 and separates variable vane 302 from casing 306.

Variable vane assembly 300 further includes a bushing 320 having a first portion 322 and a second portion 324. First portion 322 is positioned on casing 306 and extends along second recessed portion 312. A spacer 326 contacts bushing 320 and is separated from casing 306 by bushing 320. In addition, bushing 320 contacts washer 304 and separates a portion of washer 304 from spacer 326. Variable vane 302 also includes a ledge 328 having an outer wall 330 and a spacer seating surface 332. Ledge 328 surrounds a vane stem 334. Vane stem 334 and ledge 328 extend through opening 314 in casing 306. Bushing second portion 324 extends along inner wall 310 of casing 306. Bushing second portion 324 prevents ledge outer wall 330 from contacting casing inner wall 310.

Variable vane assembly 300 also includes a lever arm 336 positioned around vane stem 334 and in contact with spacer 326. Lever arm 336 is utilized to adjust the angle of vane 302, and thus alter the flow of air through the compressor. In addition, variable vane assembly 300 includes a sleeve 338 that contacts lever arm 336 and a lever arm nut 340 that contacts sleeve 338. Lever arm nut 340 cooperates with vane stem 334 and maintains variable vane assembly 300 in contact with casing 306.

Variable vane assembly 300 is a "low boss" vane assembly that has an overturning moment generated by gas loads 342 on variable vane 302. Gas loads 342 generate a pair of forces 344, 346 on variable vane assembly 300. Force 344 acts on bushing 320 and presses bushing 320 against casing second wall 312. Force 346 acts on washer 304 and presses washer 304 against casing first wall 308. Washer 304 and bushing 320 generate a low friction surface that prevents metal on metal contact.

Washer 304 and bushing 320 may fail due, at least in part, to air leakage past washer 304 and bushing 320. The high velocity and high temperature air causes oxidation and erosion of the washer and bushing resin, which leads to failure of the fibers and eventual failure of washer 304 and bushing 320. Once bushing 320 and washer 304 fail, an increased leakage past vane stem 334 occurs, which represents a performance loss. In addition, the loss of washer 304 and bushing 320 allows contact between variable vane 302, spacer 326, and casing 306 which causes wear, and increases engine overhaul costs.

Figure 4:
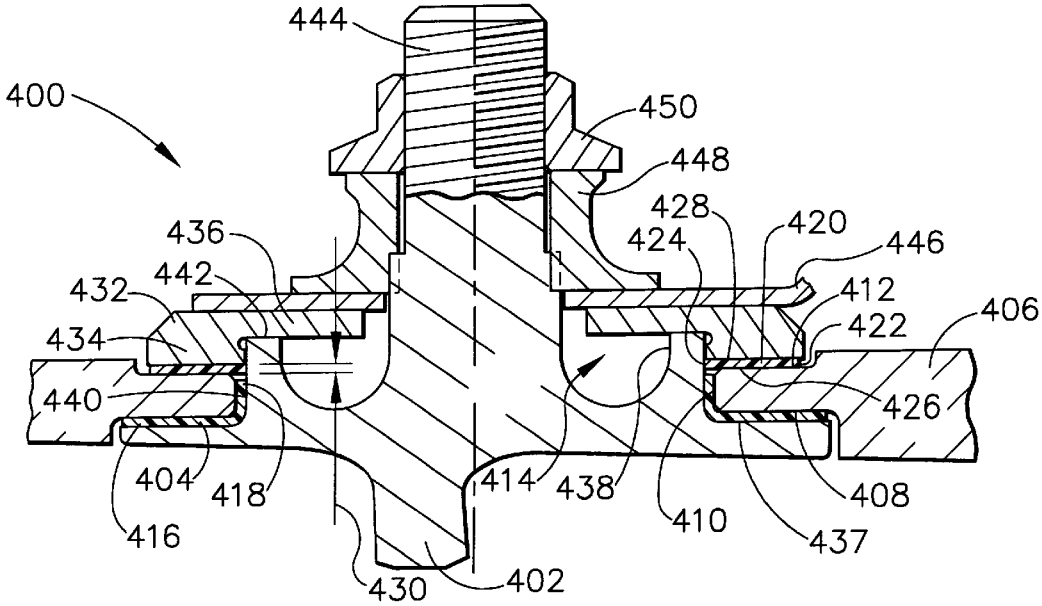
FIG. 4 is a cross-sectional view of a variable vane assembly according to one embodiment of the present invention.

FIG. 4 is a schematic view of a variable vane assembly 400 according to one embodiment of the present invention. Variable vane assembly 400 includes a variable vane 402 and a seal 404 positioned on variable vane 402. A casing 406 supports variable vane 402 and includes a first recessed wall 408, an inner wall 410, and a second recessed wall 412. An opening 414 is formed by inner wall 410.

Seal 404 includes a first portion 416 and a second portion 418. Seal first portion 416 contacts first recessed wall 408 and separates variable vane 402 from casing 406. Seal second portion 418 contacts inner wall 410 and separates variable vane 402 from casing 406. In one embodiment, seal first portion 416 extends substantially an entire length of first recessed wall 408. In addition, seal second portion 418 extends substantially an entire length of second recessed wall 412 and second portion 418 is substantially perpendicular to first portion 416. Seal 404 prevents variable vane 402 from contacting casing 406.

Variable vane assembly 400 further includes a washer 420. In one embodiment, washer 420 is substantially flat and includes a first end 422 and a second end 424. More specifically, washer 420 includes a first wall 426 and a second wall 428 that are straight and include no curves or bends. Washer 420 has a width 430 that is substantially constant from first end 422 to second end 424. Washer 420 contacts casing second recessed wall 412 and extends substantially an entire length of recessed wall 412.

Variable vane assembly 400 further includes a spacer 432 contacting washer 420. Washer 420 is for preventing contact between spacer 432 and second recessed wall 412. In one embodiment, seal 404 and washer 420 are fabricated from a low friction material such as a Teflon® and glass composite which is available from DuPont de Nemours & Co., Wilmington, Del. 19898. Spacer 432 includes a first portion 434 and a second portion 436. First portion 434 is in contact with washer 420 and has a length substantially equal to a length of washer 420. Spacer 432 is separated from seal 404 by washer 420. In one embodiment, seal 404 and washer 420 are not in contact and are separated by a short distance relative to width 430 of washer 420. Washer 420 prevents spacer 432 from contacting casing 406.

Variable vane 402 also includes a first portion 437, a ledge 438 having an outer portion 440, and a spacer seating portion 442. First portion 437 is substantially perpendicular to outer portion 440 which is substantially perpendicular to spacer seating portion 442. Ledge 438 surrounds a vane stem 444. Vane stem 444 and ledge 438 extend through opening 414 in casing 406. Seal second portion 418 extends along inner wall 410 of casing 406. Seal second portion 418 prevents ledge outer wall 440 from contacting casing inner wall 410.

Variable vane assembly 400 also includes a lever arm 446 positioned around vane stem 444 and in contact with spacer 432. Lever arm 446 is utilized to adjust the angle of variable vane 402, and thus alter the flow of air through the compressor. In addition, variable vane assembly 400 includes a sleeve 448 that contacts lever arm 446, and a lever arm nut 450 that contacts sleeve 448. Lever arm nut 450 cooperates with vane stem 444 and maintains variable vane assembly 400 in contact with casing 406.

Variable vane assembly 400 is assembled by placing seal 404 on variable vane 402 such that first portion 416 and second portion 418 contact variable vane 402 and are substantially perpendicular. Variable vane 402 and seal 404 are positioned through opening 414 in casing 406 so that seal 404 extends substantially through opening 414.

Washer 420 is placed on casing 406 adjacent seal 404. Spacer 432 is positioned on variable vane 402 and in contact with washer 420. Lever arm 438 is positioned over vane stem 444 to be in contact with spacer 432. Sleeve 448 is positioned over vane stem 444 and placed in contact with lever arm 438. Finally, lever arm nut 450 is positioned over vane stem 444 in contact with sleeve 448.

Variable vane assembly 400 may be used, for example, in a high pressure compressor. Of course, variable vane assembly 400 could also be used in other environments, such as in a low pressure compressor, a high pressure turbine, or a low pressure turbine. In addition, the components of assembly 400 can be made with slight dimensional differences to accommodate the stiffness of different materials.

The washer and seal, according to one embodiment of the present invention, have a unique geometry that will greatly reduce air leakage between the vane stem and compressor case, while still providing the function of separating the variable vane and casing with a low friction surface. The seal is installed on the inside to avoid exposing free edges to the leakage airstream, which is known to cause breakdown of the material. A fillet of the variable vane is maximized in shape to fill the existing cavity created by the variable vane and case, and to prevent expansion of the fibers on the unloaded side. The washer on the outside also does not have any edges exposed to the leakage path. All free edges on the outer diameter of the washer and the seal are within the footprint of the mating parts, which provides radial clamping, and inhibits free edge breakdown. This geometry is dimensioned to restrict airflow through the vane stem to case interface, and yet not restrict the motion of the vane in the casing bore.

The new geometry of the washer and seal will significantly restrict airflow and protect the areas of the seal vulnerable to breakdown from the airflow. Airflow is known to be the prime driver of the existing failure mode of known washers and bushings. Washer 420 and seal 404 will have a significantly longer life than known washers and bushings, and will reduce air leakage past the vane providing a small efficiency improvement. The engine overhaul costs will also be reduced because metal on metal contact between the case, vane, and spacer will be reduced or eliminated.

From the preceding description of various embodiments of the present invention, it is evident that the objects of the invention are attained. Although the invention has been described and illustrated in detail, it is to be clearly understood that the same is intended by way of illustration and example only and is not to be taken by way of limitation. Accordingly, the spirit and scope of the invention are to be limited only by the terms of the appended claims.

What is claimed is:

1. A compressor for a turbine engine, said compressor comprising:

a rotor comprising a rotor shaft and a plurality of rows of rotor blades;

a casing surrounding said rotor blades and including a first recessed portion having a first length, an inner wall having a second length, and a second recessed portion having a third length;

a washer comprising an outer edge, said washer configured to contact said casing and extend along said second recessed portion of said casing;

a spacer comprising a first portion, said washer outer edge contacting said spacer first portion and positioned within said length of said casing second recessed portion; and at least one row of variable vanes secured to said casing and extending between adjacent ones of said rows of rotor blades, said variable vanes comprising a seal configured to be in contact with said stator casing and extending substantially said first length of said first recessed portion and substantially said second length of said inner wall, said seal and said washer separated by a distance.

2. A compressor in accordance with claim 1 wherein said washer is a substantially flat washer.

3. A compressor in accordance with claim 1 wherein said washer and said seal are fabricated from a low friction material.

4. A compressor in accordance with claim 1 wherein said washer includes a first end, a second end, and a width that is substantially constant from said first end to said second end.

5. A compressor in accordance with claim 1 wherein said seal comprises a first portion and a second portion, said first portion substantially perpendicular to said second portion.

6. A compressor in accordance with claim 5 wherein said seal first portion comprises an outer edge contacting said casing first recessed portion.

7. A variable vane assembly for a turbine engine, said variable vane assembly comprising:

a variable vane including a first recessed portion having a first length, a second wall portion having a second length, and a third recessed portion having a third length;

a seal in contact with said variable vane first portion and said variable vane second portion;

a spacer including a first portion and a second portion, said spacer first portion contacting said variable vane third portion; and a substantially flat washer comprising an outer edge and positioned between said spacer and said seal, said washer outer edge contacting said spacer first portion.

8. A variable vane assembly in accordance with claim 7 further comprising a lever arm configured to surround a portion of said variable vane, said lever arm contacting said spacer.

9. A variable vane assembly in accordance with claim 7 wherein said seal is configured to prevent said variable vane from contacting a casing.

10. A variable vane assembly in accordance with claim 7 wherein said washer configured to prevent said spacer from contacting a casing.

11. A variable vane assembly in accordance with claim 7 wherein said seal comprises a first portion and a second portion, said seal first portion substantially perpendicular to said seal second portion.

12. A variable vane assembly in accordance with claim 7 wherein said spacer second portion has a length substantially equal to a length of said washer.

13. A variable vane assembly in accordance with claim 12 wherein said washer includes a first wall and a second wall, said walls having a length substantially equal to a length of said spacer second portion.

14. A variable vane assembly in accordance with claim 7 wherein said seal and said washer are separated by a distance.

15. A method for connecting a variable vane assembly to a casing, said variable vane assembly including a variable vane, a seal having a first portion and a second portion in contact with the variable vane, a washer adjacent the seal and having an outer edge, and a spacer in contact with the washer outer edge and the variable vane, said method comprising the steps of:

placing the seal on the variable vane such that the first portion and the second portion contact the variable vane and are substantially perpendicular;

positioning the variable vane and seal through an opening in the casing, wherein the seal extends substantially through said opening;

placing the washer on the casing adjacent the seal; and positioning the spacer on the variable vane in contact with the washer outer edge, wherein the washer prevents the spacer from contacting the casing.

16. A method in accordance with claim 15 wherein said step of placing the washer comprises the step of placing a substantially flat washer having a first end, a second end, and a width that is substantially constant from said washer first end to said washer second end, on the casing.

17. A method in accordance with claim 15 wherein said step of positioning the variable vane and seal in the casing comprises the step of positioning the variable vane and seal in the casing to prevent metal to metal contact between the casing and the variable vane.

18. A method in accordance with claim 15 further comprising the steps of:

positioning a lever arm over a portion of the variable vane; and placing a lever arm nut over a portion of the variable vane and in contact with the lever arm.

* * * * *